United States Patent [19]

Alter

[11] 4,041,861

[45] Aug. 16, 1977

[54] SCREEN PRINTING FRAME WITH FLOATING STRETCH-CLAMPS

[76] Inventor: David L. Alter, 112 Briarcliff Court, Hoffman Estates, Ill. 60172

[21] Appl. No.: 582,742

[22] Filed: June 2, 1975

[51] Int. Cl.[2] ..... B41F 15/36

[52] U.S. Cl. ..... 101/128.4; 38/102.91; 40/125 G; 101/127.1

[58] Field of Search ..... 101/127, 127.1, 128.1, 101/128.4; 38/102, 102.1–102.91; 40/125 G, 152, 152.1; 46/23, 26, 31; 403/401, 402; 52/758 H, 753 D

[56] References Cited

U.S. PATENT DOCUMENTS

| | | | |
|---|---|---|---|
| 2,037,991 | 4/1936 | Marity | 38/102.91 |
| 2,538,138 | 1/1951 | Webster | 403/401 X |
| 2,565,218 | 8/1951 | Freeborn | 101/127.1 X |
| 2,630,652 | 3/1953 | Amodo | 38/102.91 |
| 2,832,285 | 4/1958 | Brownlee | 101/127.1 |
| 3,336,689 | 8/1967 | Miller | 40/152 |
| 3,391,635 | 7/1968 | Matheus | 101/127.1 |
| 3,482,343 | 12/1969 | Hamu | 38/102.91 X |
| 3,572,781 | 3/1971 | Merrilees et al. | 52/758 H |
| 3,608,482 | 9/1971 | Bubley et al. | 101/127.1 |
| 3,736,684 | 6/1973 | Grad | 40/152 |
| 3,883,974 | 5/1975 | Ashton | 40/152 |

FOREIGN PATENT DOCUMENTS

| | | | |
|---|---|---|---|
| 942,283 | 11/1963 | United Kingdom | 403/401 |

*Primary Examiner*—Edgar S. Burr
*Assistant Examiner*—R. E. Suter
*Attorney, Agent, or Firm*—Darbo, Robertson & Vandenburgh

[57] ABSTRACT

On each of its sides, the fabric or mesh of a printing screen is clamped by clamping means which can be drawn outwardly to stretch the fabric. So that the stretching of the fabric in one direction will not be hampered by the clamping means for the other direction of stretch, the clamping means for each side includes floating clamp portions which may separate from one another longitudinally of a pull bar by which they are carried. The pull bars are drawn outwardly (with all of the clamps thereon) for stretching the fabric. The tendency toward troublesome distortion of the strands of the fabric, and the danger of tearing the fabric (even if of metal) are thus substantially eliminated.

7 Claims, 4 Drawing Figures

SCREEN PRINTING FRAME WITH FLOATING STRETCH-CLAMPS

INTRODUCTION

The invention of which the present disclosure is offered for public dissemination in the event adequate patent protection is available relates to screen used for printing by the process often called "silk screen printing". It is, of course, desirable to stretch the fabric of such a screen so that it will be taut and smooth. According to prior practice deemed to be best, the fabric was carried by a rigid rectangular frame, or chase, being drawn taut across it by clamps, one extending along and gripping each side of the fabric, which each opposing pair of clamps drawn apart from one another to stretch the clamped fabric.

This presented problems, especially adjacent to the clamps, this problem being most severe at and near the corners between adjacent clamps. By virtue of clamping a fabric all along one side, each clamp would prevent the stretching of the part of the fabric which was clamped firmly within it. The disparity between the nonstretching within a clamp and the stretching parallel to the length of the clamp by the adjacent clamps throughout the remainder of the screen area produced a progressively increasing distortion of the individual strands of the fabric. At the corners there could even be tearing of the fabric. Trouble due to distortion of the individual strands is much more commonly encountered, however. Whenever the distortion pulled individual strands of the fabric within the useful area into a distorted or nonlinear condition, the results were likely to be unsatisfactory, especially where precision work was involved. For example, in the course of many printings (in which the fabric is flexed with a squeegee) changes may occur as a result of the distorted strands which change the placement of details of the printed design.

According to the present invention this problem is completely avoided, no matter how large the frame, by providing along each side of the frame a set of floating clamp units which can move longitudinally of the side on which they are located so as to spread apart slightly under the stretching influence of the adjacent clamps. In effect, the clamp on each side stretches with the fabric so that wrinkling and corner strains are avoided.

The advantages of the invention will be more apparent from the following description and from the drawings.

DESIGNATION OF FIGURES

BACKGROUND DESCRIPTION

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

Figure 1:
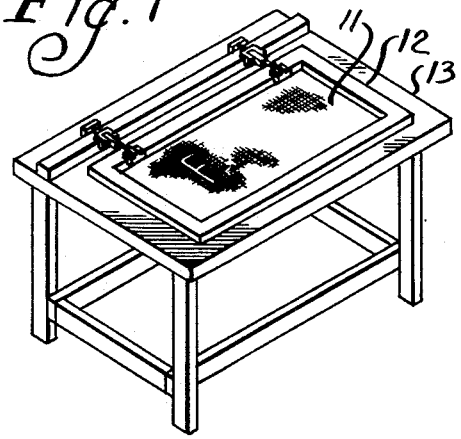
FIG. 1 is a perspective type view showing the field in which the invention is used, by illustrating a screen-printing table using a frame which may be that of the present invention.

Screen printing is an old art which for many years was known as silk screen printing. The screen fabric 11, which now is more likely to be synthetic fabric such as nylon or stainless steel fabric, is treated to be selectively impervious, the selectivity in this instane being indicated by the letter F. The fabric is preferably carried in stretched out conditions by frame 12 which facilitates its being applied to the workpiece. With the older hand method of printing, the workpiece to be prindted would reset on a table 13 as in FIG. 1, thus lying under and only slightly out of contact with the fabric 11. The printing ink or other printing material is applied to the top face of the fabric 11 in such a manner that it penetrates through the fabric to the workpiece except where the fabric has been made impervious. The workpiece is therefore printed with the design of the fabric.

Usually raw fabric is stretched in the frame, and its preparation for printing may be done with the aid of photographic processes so that it is practicable to reproduce accurately by screen-printing a very complex design or drawing. Screen printing is used, for example, for complex printed circuitry.

It has been the practice heretofore to apply a clamp to each edge of the fabric 11 and to stretch the fabric by screws 14 extending through the outer flange 16 of frame 12 and threading into the clamp to draw the clamp outwardly. Thus, referring to FIG. 3, the screws 14 would draw one edge portion 17 of fabric 11 outwardly toward the outer flange 16 of the frame 12. The fabric 11 would thus be stretched across the open space or window 18 formed by the four inner flanges 19 of frame 12.

A difficulty which has been encountered for years lies in widespread distortion; and strains, especially at the corners, which sometimes cause tearing. On analysis, it is seen that this results from the fact that the portion 17 of the fabric where it is firmly engaged by the clamp is restrained by the clamp from stretching lengthwise of the clamp. Accordingly, with each clamp extending substantially the full length of one side of the fabric, the clamped side portion of the fabric could not stretch along the length of that side, when the adjacent clamps stretched the fabric lengthwise of the clamp in question. In other words, there would be a disparity between the main body of he fabric which would be stretched by two opposing clamps and the intervening edge of the screen which was restrained (from the stretching just mentioned) by the clamp extending along the length of that edge. This disparity was usually evidenced by distortion of strands, most noticeably in the corner zone 21 between adjacent clamps. Sometimes this distortion would cause strains so severe that tearing of the fabric would result. There is a percentage difference in elongation caused by stretching various different screen fabrics. Stainless steel, or other metal meshes, require less stretch than would a polyester fabric and still less than nylon. As the mesh was stretched tautly by the action of pulling the bars away from the center of the screen frame, a severe strain was necessarily placed upon the corners of the mesh, it having been more noticeable in those fabrics that require greater elongation to bring the mesh to the proper tension.

DESCRIPTION OF THE PRESENT INVENTION

According to the present invention, the screws 14 on one side of the frame 12 are all threaded into one clamp-carrier bar 23 on which a series of clamps 24 are slidably carried. As clearly seen in FIG. 3, the slidably coaction may be by means of a T slot 26 extending lengthwise of each clamp 24 and a T flange or rail 27 formed on the bar 23 and extending the full length thereof. Thus the bar 23 is a flanged trackway. Preferably the T slot 26 has substantially (ie., appreciably) greater dimensions in the direction of the head of the T than the T flange 27 so that the slight flexing of the bar 23 which may be expected to occur on occasion will not cause binding to inhibit the sliding of the clamps 24 on the T flange 27. Other flanged interfits may be used, as well as constructions of remote nature which exert the necessary pull on a series of clamps while permitting them to separate slightly to accommodate themselves to the stretching of the fabric or web the edge of which they hold. For ease of sliding, the sliding parts should engage one another with slide faces, as shown, rather than with line contact or the like which might impede sliding.

Figure 3:
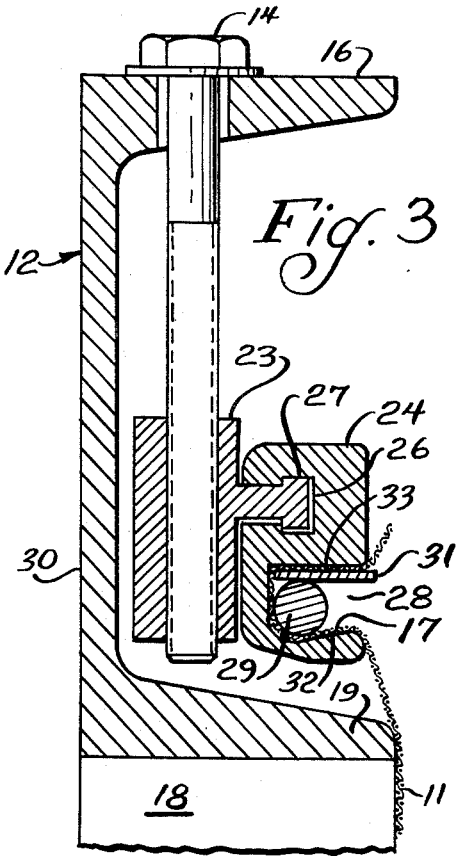
FIG. 3 is a cross-sectional view through one side of the frame and fabric, being taken approximately on the line 3 — 3 of FIG. 2.

At the start of an operation, the various clamps 24 will be slid together, thus engaging the edge of the screen with substantial continuity initially; and they will be more or less centered along the length of the bar 23. The fabric 11 will be stretched out manually across the window 18. The edge portion of the fabric will then be inserted and clamped in the successive clamps 24. A preferred type of clamping means which (as to the manner in which it grips the fabric) is new with the present invention only in using separated short lengths, is illustrated in FIG. 3. The clamp 24 is provided with a rearwardly diverging longitudinal groove 28. After a round rod 29, together with an encasing edge portion 17 of the fabric, have been tucked into the groove 28, a lock bar 31 is inserted on the outer side of the rod 29 as seen in FIG. 3. This lock bar is thick enough so that the rod 29 cannot pass out forwardly through the mouth of the groove 28, but its effort to do so will firmly clamp the fabric edge portion 17. The wedging of the outwardly-pulled assembly of bar 31 and rod 29 between surfaces 32 and 33 results in pressures on the mesh against the walls of groove 28, firmly securing the mesh. The surface 32 and the opposing surface 33 are disposed to have slight covergence toward one another outwardly of the groove 28, or toward its mouth. For each clamp 24 there is a separate rod 29 and lock bar 31, each the length of clamp 24.

When all four sides of the fabric have thus been clamped, various screws 14 will be turned in a direction to stretch the fabric 11 by moving their respective clamp-carrying bars 23 outwardly. The screws are inherently capable of stretching the screen with dimensional uniformity even when the stretching tension needed to achieve this is uneven.

Because a series of clamps 24 is provided which may slide on the T flange 27, this sliding will occur instead of causing cumulative distortion increasing toward the corners 21. Thus, when the end clamp bars E are drawn apart by their respective screws 14, the various clamps 24 on the longitudinal bar L will spread apart slightly (through perhaps not as much as illustrated) so that the strands of the fabric 11 which are clamped within the end clamps 24 on longitudinal bar L can retain substantially their straight-line condition as viewed from the fabric of the screen. Perhaps only the strands near the center of each clamp will remain truly undistorted by stretching, but there is so little accumulation of distortion to the end of each short clamp that no troublesome distortion is encountered.

Although some slight distortion may occur with the present invention, the total distortion along one side, which formerly could only be progressively increased at least over the distance from a midpoint to each of the two corners, is now cumulative for no more than half the length of one clamp. In addition, if it be assumed that some slight longitudinal slippage within the clamp may occur adjacent the ends of the clamps (as could certainly be the case if the longitudinal stretching is completed before the transverse stretching causes firm gripping within the clamp) this slippage-adjustment can occur at many clamp-ends instead of at only two clamp-ends. Thus in FIG. 2 along longitudinal bar L there are 12 clamp-ends at which this slight readjustment slippage can occur. This may greatly reduce the total amount of distortion, as well as interrupting its cumulative nature at numerous points.

Preferably the engagement between T bars 27 and slide-clamps 24 is of friction-reducing character. Rolling bearings could be provided if cost-justified, but for present uses of the invention, sufficient friction reduction results from "Teflon"-impregnated anodizing of at least one of the sliding surfaces. The bars 23 and clamps 24 may be thus anodized throughout their surfaces. It would be enough, however, to thus anodize the surfaces of the groove 26 which are drawn into firm engagement with T flange 27 by the tension of the fabric 11. The surfaces should of course be smooth, as results from extrusion. It is not essential that all of the clamps be slidable. One at each end toward which stretching occurs would be better than none. All slidable except a center clamp would be much better, but would necessitate drawing opposite sides equally to leave the center between them unmoved. Making them all slidable is therefore most desirable.

FIELD ASSEMBLY

Figure 2:
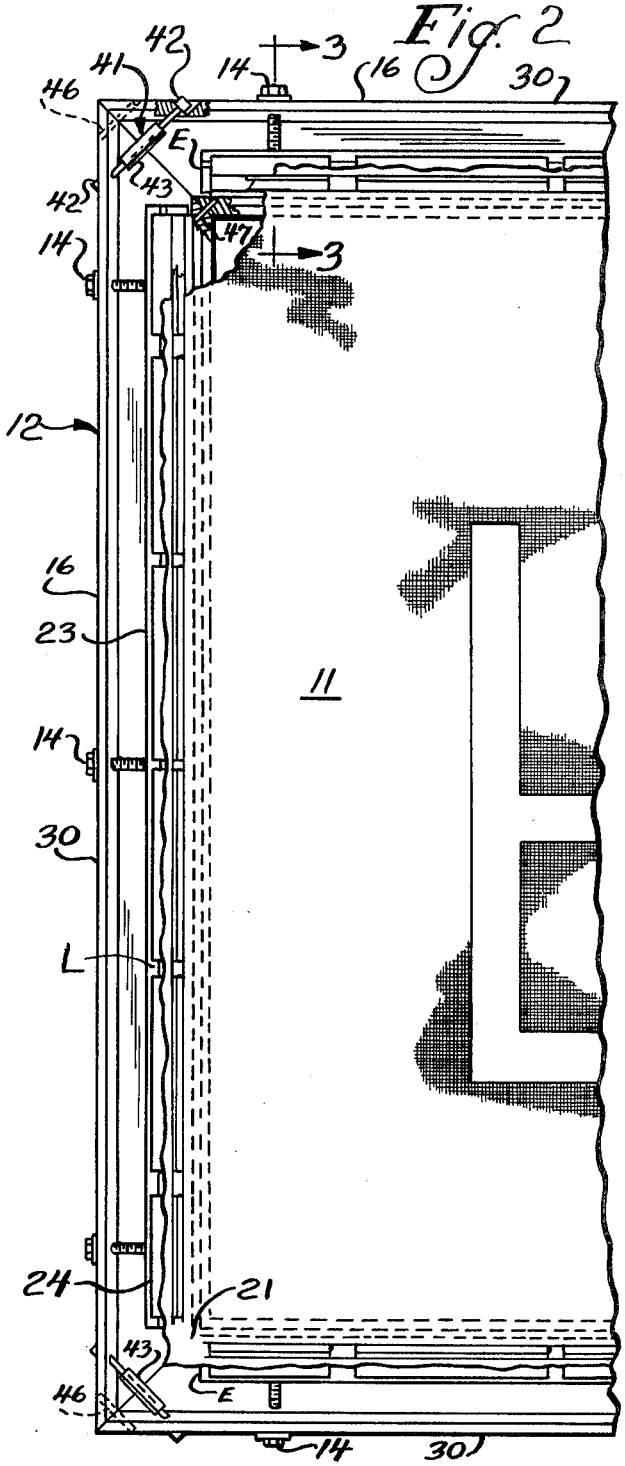
FIG. 2 is a fragmentary view showing the underside of the frame chosen for illustration of the present invention, with the fabric stretched thereon.

For shipping or storage, or for assembly of a wide variation of sizes from a relatively small number of pieces, it may be desirable for the frame 12 to be readily assembled and disassembled in the field. To this end the four main side bars 30 of frame 12 are preferably not welded or cemented together but are held together as separable assemblies. In FIG. 2 the screw assemblies 41 draw the mitered ends into firm contact. So that any two side bars of a set may be adjacent pieces, their ends are mitered at 45° and the screw devices 41 are arranged as shown, one across each corner, identically located. In the illustrated form, each screw assembly 41 includes a pair of screws 42, each passing through and bearing on an outer flange 16 and threaded into a tube 43. Thus each screw device has threads between two of its parts, to be usable with any two side bars without any threading of the side bars. Although these screw devices may be called turnbuckles, all screws preferably have right-handed threads and the tightening can usually be done with two screwdrivers without special effort at turning or restraining the tube 43 except for the initial coupling turns.

Proper alignment of the respective pieces to hold the fabric in planar condition is ensured by dowels, across and perpendicular to the mitered end faces of the bars, one near the outer flanges as seen at 46 in FIG. 2 and one through the inner flanges as seen at 47 in FIG. 2.

The combination of the well-separated dowels 46 and 47 and the diagonal screw units 41 located reasonably close to the central area of each corner joint provides a very sturdy and dependably square and planar frame.

Although the frame is made of four channel-bar side pieces which are quite sturdy, some bowing under the tension of the fabric has been encountered. It may therefore be desired to add truss-like reinforcement to these members. Such truss reinforcement is more likely to be necessary with the preferred lightweight metals or wood than if steel were to be used. Lightweight metal, such as aluminum, is preferred.

Figure 4:
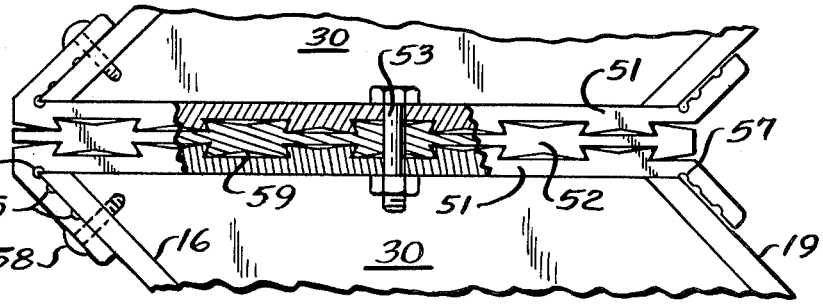
FIG. 4 is a fragmentary view showing a further improved corner construction.

To be sure to show the best form contemplated, another ingenious new corner construction is shown in FIG. 4. To each of the 45°-mitered ends of the side bars, a dovetailing coupling shoe 51 is attached as by epoxy cement. Although shoes 51 could be made to dovetail to each other, it is at present preferred to make them all alike, and couple them by inserting between them a dovetail coupler 52, as seen in FIG. 4. A bolt 53 may be inserted. If tightening of this bolt by its nut is found not to be necessary, a snap-in pin could be substituted; or other means to prevent sliding of the joint parts until disassembly was desired could be used. The dovetail parts (ribs and grooves) should fit snugly to ensure firmness and a planar condition of the frame. The dovetail parts are elongated, extending the full outside depth dimensions of the side bars. Grooves 55 may be provided to aid cementing. An adhesive found to be highly satisfactory in 3M's "SCOTCHWELD" structural adhesive. Of course the shoes 51 are not to be removed from their respective side bars 30, and could be welded to them. Corner grooves 56 may be provided to be sure no fillet will impede seating of the faces of side bars 50 in shoes 51. Similar corner grooves 57 may also be provided, but are probably not need because clearance is expected, as shown. Securing means such as one or two screws 58 or rivets through the acute-angle flange of shoe 51 ensures uniformity by making sure no clearance is left on the outer side of bars 30, and that each shoe 51 is centered on bars 30. The dovetailing, the securing means 58 and the bolts 53 combine to ensure a planar face for the frame of FIG. 4, just as the dowels do for the frame of FIG. 2.

Preferably the dovetailing ribs of shoes 51 and coupler 52 have their front faces dished in or receding from the edges as at 59, or spaced (except along the edge zones) from the surfaces they face, to facilitate providing just the right snugness and smooth telescopic action.

ACHIEVEMENT

From the foregoing it is seen that screen printing frames are provided which virtually eliminate troublesome distortion of the strands of the fabric which has heretofore resulted from stretching the fabric. This is especially valuable in greatly facilitating precision printing. It also removes all danger of excessive strain or tearing of the fabric at the corners of the screen, and removes the need for excessive care to avoid tearing.

I claim:

1. A frame for stretching screen fabrics including four rigid side members joined in a frame, means for stretching a screen fabric across the frame in a first direction, and means for stretching the fabric across the frame in a second direction transverse to the first, at least one of said means including clamp-holding pull bars on opposite sides of the frame, and a series of clamps carried by each of said bars, for clamping an edge portion of said fabric therein with said clamps initially clamping substantially all parts of said edge portion throughout the extent of said series of clamps; and means for moving said bars apart, together with the clamps thereon, to stretch the fabric in the direction transverse of the bars, with uniform movements of the various clamps to stretch the fabric with dimensional uniformity even if the stretching tension is uneven; at least some of said clamps near ends of the bars having slide faces slidably engaging a substantially continuous slide face of the bar to be readily slidable on the bars lengthwise of the clamped edge, while said slide faces are subject to contact pressure from said stretching tension, so as to accommodate themselves to stretching of the fabric lengthwise of the bars.

2. A frame for stretching screen fabrics including four rigid side members joined in a frame, means for stretching a screen fabric across the frame in a first direction, and means for stretching the fabric across the frame in a second direction transverse to the first, at least one of said means including clamp-holding pull bars on opposite sides of the frame, and a series of clamps carried by each of said bars, for clamping an edge portion of said fabric therein with said clamps initially clamping substantially all parts of said edge portion throughout the extent of said series of clamps; and means for moving said bars apart, together with the clamps thereon, to stretch the fabric in the direction transverse of the bars, with uniform movements of the various clamps to stretch the fabric with dimensional uniformity even if the stretching tension is uneven; at least some of said clamps near ends of the bars having slide faces slidably engaging a substantially continuous slide face of the bar to be readily slidable on the bars lengthwise of the clamped edge, while said slide faces are subject to contact pressure from said stretching tension, so as to accommodate themselves to stretching of the fabric lengthwise of the bars; said slide faces being provided by means of flanged trackway for movement of the clamps longitudinally of the bars while they are restricted from yielding toward said fabric.

3. A clamp assembly for holding an edge of screen-fabric material or the like which is to be stretched; said assembly including an elongate rail to be positioned along said edge, and a series of separate clamps carried by said rail for clamping therein said edge of such material along which said rail may be positioned, and capable of being arranged on said rail in contiguity with one another for collectively clamping substantially all parts of the edge within the extend of said series of clamps along the edge, and at least one of which clamps, located at an end of the series, has a slide face engaging a longer slide face of the rail to be readily slidable longitudinally of the rail in accommodation of the stretching of the material, even while said slide faces are subjected to contact pressure due to fabric tension in the direction transverse to the rail.

4. A rigid four-sided frame for stretching screen-printing fabrics including clamp-holding bars extending along all four sides of the frame to provide two sets of opposed generally parallel bars; and a series of clamps carried by each of said bars, for clamping an edge portion of said fabric therein with generally all parts of the edge portion for the length of each series being clamped in said series of clamps; and means for moving a movable one of said bars of each set for the separation of the bars of each set, together with the clamps thereon, to stretch the fabric uniformly in the direction of their separation at least some of said clamps relatively near the ends of each of the bars being readily shiftable along the bars lengthwise of the bar, while subject to said stretching tension to separate minutely from other clamps in the series under the influence of the stretching of the fabric lengthwise of one pair of bars by the increased separation of the other pair of bars.

5. A rigid four-sided frame for stretching screen printing fabrics including clamp-holding bars extending along all four sides of the frame to provide two sets of opposed generally parallel bars; and a series of clamps carried by each of said bars, for clamping an edge portion of said fabric therein with generally all parts of the edge portion for the length of each series being clamped in said series of clamps; and means for increasing the separation of each series of clamps from the other series of the same set, to stretch the fabric in the direction of their separation; at least some of said clamps of each series relatively near the ends of the bars being readily shiftable along the bars lengthwise of the bar, while subject to the tension of fabric they have stretched, to separate minutely from other clamps in the series under the influence of the stretching of the fabric lengthwise of one pair of bars by the increased separation of the other pair of bars.

6. The method of stretching a screen-printing fabric substantially free of distortion which comprises clamping edge portions of its four sides in clamps carried along the four sides of a rigid four-sided frame which includes clamp-holding bars extending along opposite sides of the frame to provide a set of opposed generally parallel bars, and a series of clamps carried by each bar of said set; with generally all parts of the edge portion for the length of each series of clamps being clamped therein; increasing the separation of said bars to stretch the fabric in both directions; and by said stretching causing at least some of said clamps of each series relatively near the ends of the bars to shift along the bars lengthwise of the bar, while subject to tension of fabric they have stretched, to separate minutely from other clamps in the series.

7. A rigid four-sided frame for stretching screen-printing fabrics; a series of clamps carried by each side of the frame, for clamping an edge portion of said fabric therein with generally all parts of the edge portion for the length of each series being clamped in said series of clamps; and means for moving the clamps on at least two adjacent sides to stretch the fabric in both directions with the stretch in each direction being substantially uniform as to the linear extent of the stretching even if the resulting stretching tension is uneven; at least some of said clamps relatively near the ends of each series being readily shiftable lengthwise of that series, while subject to said stretching tension, to separate minutely from other clamps in the series under the influence of the stretching of the fabric lengthwise of that series.

* * * * *